United States Patent [19]

Mohr et al.

[11] Patent Number: 4,618,405

[45] Date of Patent: Oct. 21, 1986

[54] PROCESS FOR THE ELECTROCHEMICAL ROUGHENING OF ALUMINUM FOR USE AS PRINTING PLATE SUPPORTS, IN AN AQUEOUS MIXED ELECTROLYTE

[75] Inventors: Dieter Mohr, Schlangenbad; Werner Frass, Wiesbaden-Naurod, both of Fed. Rep. of Germany

[73] Assignee: Hoechst Aktiengesellschaft, Frankfurt am Main, Fed. Rep. of Germany

[21] Appl. No.: 726,244

[22] Filed: Apr. 23, 1985

[30] Foreign Application Priority Data

Apr. 25, 1984 [DE] Fed. Rep. of Germany ..... 3415364

[51] Int. Cl.[4] ..... C25F 3/04

[52] U.S. Cl. ..... 204/129.75; 204/129.95

[58] Field of Search ..... 204/129.4, 129.75, 129.85, 204/129.95, 33, 38.7

[56] References Cited

U.S. PATENT DOCUMENTS

| | | | |
|---|---|---|---|
| 3,755,116 | 8/1973 | Terai et al. | 204/129.95 |
| 3,887,447 | 6/1975 | Sheasby et al. | 204/129.4 |
| 4,052,275 | 10/1977 | Gumbinner et al. | 204/129.95 |
| 4,172,772 | 10/1979 | Ould et al. | 204/129.85 |
| 4,339,315 | 7/1982 | Kikuchi et al. | 204/129.85 |
| 4,367,124 | 1/1983 | Kikuchi et al. | 204/17 |

FOREIGN PATENT DOCUMENTS

| | | | |
|---|---|---|---|
| 1400918 | 7/1975 | United Kingdom | 204/129.75 |

OTHER PUBLICATIONS

A. J. Dowell, "The Alternating Current Etching of Aluminium Lithographic Sheet", Transactions of the Institute of Metal Finishing, vol. 57, pp. 138–144, 1979.

Chemical Abstracts, vol. 93, Nr. 35852b, p. 618.

Chemical Abstracts, vol. 95, Nr. 143008f, p. 714.

*Primary Examiner*—T. M. Tufariello

*Attorney, Agent, or Firm*—Schwartz, Jeffery, Schwaab, Mack, Blumenthal & Evans

[57] ABSTRACT

Disclosed is a process for electrochemically roughening aluminum or aluminum alloys for use as printing plate supports, in an aqueous mixed electrolyte solution containing hydrochloric acid (HCl) and, as an additional inorganic electrolyte, at least one compound selected from the group consisting of condensed phosphoric acids, amidosulfonic acid, and the water-soluble alkali metal salts and ammonium salts thereof. In particular, the solution contains from 0.5 to 10% by weight of HCl and from 0.05 to 5.0% by weight of the additional inorganic electrolyte (for example, diphosphoric acid or polyphosphoric acid). The support materials which are particularly uniformly roughened are employed in the production of offset-printing plates.

16 Claims, No Drawings

PROCESS FOR THE ELECTROCHEMICAL ROUGHENING OF ALUMINUM FOR USE AS PRINTING PLATE SUPPORTS, IN AN AQUEOUS MIXED ELECTROLYTE

BACKGROUND OF THE INVENTION

The present invention relates to a process for the electrochemical roughening of aluminum which can be used for printing plate supports, said process being performed by means of alternating current in an aqueous mixed electrolyte.

Printing plates (this term referring to offset-printing plates, within the scope of the present invention) usually comprise a support and at least one radiation-sensitive (photosensitive) reproduction layer arranged thereon, the layer being applied to the support either by the user (in the case of plates which are not pre-coated) or by the industrial manufacturer (in the case of pre-coated plates). As a layer support material, aluminum or alloys thereof have gained general acceptance in the field of printing plates. In principle, it is possible to use these supports without modifying pretreatment, but they are generally modified in or on their surfaces, for example, by a mechanical, chemical and/or electrochemical roughening process (sometimes also called graining or etching in literature), a chemical or electrochemical oxidation process and/or a treatment with hydrophilizing agents. In modern continuously working high-speed equipment employed by the manufacturers of printing plate supports and/or precoated printing plates, a combination of the aforementioned modifying methods is frequently used, particularly a combination of electrochemical roughening and anodic oxidation, optionally followed by a hydrophilizing step. Roughening is, for example, carried out in aqueous acids, such as aqueous solutions of HCl or $HNO_3$ or in aqueous salt solutions, such as aqueous solutions of NaCl or $Al(NO_3)_3$, or also in combinations of these components, using alternating current. The peak-to-valley heights (specified, for example, as mean peak-to-valley heights $R_z$) of the roughened surface, which can thus be obtained, are in the range from about 1 to 15$\mu$m, particularly in the range from 2 to 8 $\mu$m. The peak-to-valley height is determined according to DIN 4768, in the October 1970 version. The peak-to-valley height $R_z$ is thus the arithmetic mean calculated from the individual peak-to-valley height values of five mutually adjacent individual measurement lengths.

Roughening is, inter alia, carried out in order to improve the adhesion of the reproduction layer to the support and to improve the water/ink balance of the printing form which results from the printing plate upon irradiation (exposure) and development. By irradiating and developing (or decoating, in the case of electrophotographically working reproduction layers), the ink-receptive image areas and the water-retaining non-image areas (generally the bared support surface) in the subsequent printing operation, are produced on the printing plate and thus the actual printing form is obtained. The final topography of the aluminum surface to be roughened is influenced by various parameters, as is explained by way of example in the text which follows:

The paper "The Alternating Current Etching of Aluminum Lithographic Sheet", by A. J. Dowell, published in *Transactions of the Institute of Metal Finishing*, 1979, Vol. 57, pages 138 to 144, presents basic comments on the roughening of aluminum in aqueous solutions of hydrochloric acid, based on variations of the following process parameters and an investigation of the corresponding effects: The electrolyte composition is changed during repeated use of the electrolyte, for example, in view of the $H^+(H_3O^{30})$ ion concentration (measurable by means of the pH) and in view of the $Al^{3+}$ ion concentration, with influences on the surface topography being observed. Temperature variations between 16° C. and 90° C. do not show an influence causing changes until temperatures are about 50° C. or higher, the influence becoming apparent, for example, as a significant decrease in layer formation on the surface. Variations in roughening time between 2 and 25 minutes lead to an increasing metal dissolution with increasing duration of action. Variations in current density between 2 and 8 A/dm$^2$ result in higher roughness values with rising current density. If the HCl concentration is varied in a range from 0.17 to 3.3%, only negligible changes in pit structure occur between 0.5 and 2% of HCl. Below 0.5% of HCl, the surface is only locally attacked, and at the high values an irregular dissolution of Al takes place. An addition of $SO_4^{2-}$ ions or $Cl^-$ ions in the form of salts (e.g., by adding $Al_2(SO_4)_3$ or NaCl) can also influence the topography of the roughened aluminum. Rectification of the alternating current shows that, obviously, both half-wave types are necessary to obtain a uniform roughening.

Thus, it can be assumed that the use of aqueous HCl solutions as electrolyte solutions for the electrochemical roughening of support materials made of aluminum is principally known. With these solutions it is possible—as is also evidenced by a great number of commercially available printing plates—to achieve a uniform graining, which is particularly suitable for applications in the field of lithography, and the roughness values of which vary within a range which in general is appropriate for practical use. For certain applications of printing plates (for example, in the case of certain negative-working reproduction layers) there is, however, required a uniform surface topography showing relatively little depth of roughening, which is difficult to obtain in the known electrolyte solutions on a basis of aqueous HCl solutions, using modern, high-speed apparatus. For example, the process parameters must be kept within very narrow limits, which involves a process that can be controlled only with great difficulty.

The influence of the electrolyte composition on the quality of roughening is, for example, also described in the following publications, in which aqueous mixed electrolytes are employed:

German Offenlegungsschrift No. 22 50 275 (equivalent to British Published Application No. 1,400,918) specifies aqueous solutions containing from 1.0 to 1.5% of $HNO_3$ or from 0.4 to 0.6% of HCl and, optionally, from 0.4 to 0.6% of $H_3PO_4$, for use as electrolyte solutions in the roughening of aluminum for printing plate supports, by means of alternating current;

U.S. Pat. No. 3,887,447 specifies aqueous solutions containing from 0.2 to 2% of HCl and from 0.15 to 1.5% of $H_3PO_4$, for use as electrolyte solutions in the roughening of aluminum by means of alternating current;

U.S. Pat. No. 4,052,275 specifies aqueous solutions containing from 0.75 to 3.5% of HCl and from 0.2 to 1% of tartaric acid [2,3-dihydroxybutanedioic acid 1,4)] for use as electrolyte solutions in the roughening of aluminum;

U.S. Pat. No. 4,172,772 specifies aqueous solutions containing from 0.2 to 1.7% of HCl and from 0.5 to 4% of an alkanoic acid from $C_1$ to $C_4$ (particularly acetic acid, also known as ethanoic acid), for use as electrolyte solutions in the roughening of aluminum, by means of alternating current;

U.S. Pat. No. 4,367,124 specifies aqueous solutions containing from 0.35 to 3.5% of HCl and from 0.001 to 2% of a $\beta$-dicarbonyl compound, such as acetylacetone or acetoacetic acid ethyl ester, for use as electrolyte solutions in the roughening of aluminum support materials for printing plates;

U.S. Pat. No. 4,339,315 specifies aqueous solutions containing from 0.1 to 1.0 mole/l of HCl and from 0.01 to 1 mole/l of citric acid or malic acid [3-hydroxy-pentanetrioic acid (1,3,5) and 2-hydroxybutanedioic acid (1,4)], for use as electrolyte solutions in the roughening of aluminum support materials for printing plates; and U.S. Pat. No. 3,755,116 specifies an addition of anticorrosive agents—including monoamines, diamines, aliphatic aldehydes, carboxylic acid amides, such as acetamide, urea, chromic acid and nonionic surfactants, such as polyethylene glycol ethers or esters—to an aqueous HCl electrolyte, for roughening aluminum for printing plate supports.

The known organic additives to aqueous acid electrolytes, such as HCl or $HNO_3$ solutions, have the disadvantage that in the case of high current loads (voltages) they become electrochemically unstable in modern continuously working web processing apparatus and decompose at least partially. The known inorganic additives, such as phosphoric acid, chromic or boric acid, exhibit the disadvantage that quite often there is a local breakdown of their intended protective effect, as a consequence whereof single, particularly deep pits are formed at the respective spots. An addition of $H_3PO_4$, for example, can result in surfaces in which roughening is shallow, but which have the disadvantage of showing many deep individual pores.

In general, the known complex-forming additives accelerate the dissolution of the aluminum due to their "trapping" of released $Al^{3+}$ ions and thus cause an increased roughening action. As a result thereof, quite often no creation of new pores is initiated, but pores which are already existent continue to grow, i.e., increased pitting occurs. It is true that usually the growth of individual pores is stopped relatively soon by the known inhibiting additives, and the formation of new pores can be initiated. These inhibitors exhibit, however, the decisive disadvantage that this protective effect can collapse due to voids, alloying constituents, and the like, so that single pores which are too deep are obtained on a surface which otherwise shows a shallow and uniform roughening. Support materials exhibiting this kind of defect are not suitable for lithographic purposes.

SUMMARY OF THE INVENTION

It is therefore an object of the present invention to provide a process for the electrochemical roughening of aluminum for printing plate supports. Another object of the invention is to provide a means by which a uniformly roughened surface topography with a large range of variation in the means peak-to-valley roughness values is achieved. Still another object of the invention is to provide a process for electrochemical roughening in which long useful lives of the baths used can be obtained. Yet another object of the invention is to provide a composition for electrochemical roughening. Still another object of the invention is to provide a printing plate support material made in accordance with the process of the invention.

These and other objects of the invention are achieved by a process for electrochemical roughening of a material selected from aluminum and aluminum alloys, comprising the steps of placing the material in an aqueous mixed electrolyte solution containing HCl and at least one additional electrolyte selected from condensed phosphoric acids, amidosulfonic acid, and the water-soluble alkali metal salts and ammonium salts of any of the above acids, and subjecting the material to the action of alternating current to effect roughening of the material surface.

A composition for chemical roughening of aluminum or aluminum alloys comprises an aqueous mixed electrolyte solution containing HCl and one or more additional inorganic electrolytes selected from condensed phosphoric acids, amidosulfonic acid, and the water-soluble alkali metal salts and ammonium salts of any of the above acids.

A printing plate support material comprises a plate of aluminum or aluminum alloy having a roughened surface produced by placing the material in an aqueous mixed electrolyte solution containing HCl and at least one additional electrolyte selected from condensed phosphoric acids, amidosulfonic acid, and the water-soluble alkali metal salts and ammonium salts of the above acids, and subjecting the material to the action of alternating current to effect roughening of the material surface, and a radiation sensitive layer applied over the roughened surface.

DESCRIPTION OF THE PREFERRED EMBODIMENTS

The present invention is based on the known process for the electrochemical roughening of aluminum or aluminum alloys for use as printing plate supports in an aqueous mixed electrolyte solution containing HCl and at least one additional inorganic electrolyte, under the action of alternating current. In the process of the invention, the inorganic electrolyte comprises a compound selected from the group consisting of condensed phosphoric acids, amidosulfonic acid, and the water-soluble alkali-metal salts and ammonium salts thereof. In a preferred embodiment, the aqueous electrolyte solution contains from 0.5 to 10.0% by weight, particularly from 0.8 to 5.0% by weight, of HCl and from 0.05 to 5.0% by weight, particularly from 0.1 to 2.0% by weight, of the additional electrolyte.

The condensed phosphoric acids include, in particular, diphosphoric acid ($H_4P_2O_7$) and various polyphosphoric acids ($H_{n+2}P_nO_{3n+1}$, for example, with n=3 or 6 or $H_nP_nO_{3n}$, for example, with n=6) and the salts include sodium salts of these acids, such as sodium pyrophosphate ($Na_4P_2O_7$), sodium tripolyphosphate ($Na_5P_3O_{10}$), sodium hexametaphosphate ($Na_6P_6O_{18}$) and sodium hexapolyphosphate ($Na_8P_6O_{19}$).

Suitable base materials for the material to be roughened in accordance with this invention include aluminum or one of its alloys which, for example, have an Al content of more than 98.5% by weight and additionally contain small amounts of Si, Fe, Ti, Cu and Zn. Prior to the electrochemical treatment step, these aluminum support materials can be roughened—optionally after precleaning step—by mechanical means (for example, by brushing and/or by treatment with an abrasive agent). All process steps can be carried out discontinuously using plates or foils, but preferably they are performed continuously using webs.

Particularly in continuous processes, the process parameters in the electrochemical roughening step are normally within the following ranges: temperature of the electrolyte 20° C. to 60° C., current density 3 to 200 $A/dm^2$, dwell time of a material spot to be roughened in the electrolyte 1 to 300 seconds, and rate of flow of the electrolyte on the surface of the material to be roughened 5 to 100 cm/s. In discontinuous processes, the required current densities are rather in the lower region and the dwell times rather in the upper region of the ranges indicated in each case, a flow of the electrolyte can even be dispensed within these processes. The type of current used usually is normal alternating current having a frequency of 50 to 60 Hz, but it is also possible to use modified current types, such as alternating current having different current intensity amplitudes for the anodic and for the cathodic current, lower frequencies, interruptions of current or superposition of two currents or different frequencies and wave shapes. The average peak-to-valley height $R_z$ of the roughened surface is in a range from 1 to 15 μm, in particular from 1.5 to 8.0 μm. In addition to HCl and at least one of the additional inorganic electrolytes, the aqueous electrolyte may be admixed with aluminum ions in the form of aluminum salts, in particular 0.5 to 5.0% by weight of $AlCl_3$.

Precleaning includes, for example, treatment with an aqueous NaOH solution with or without a degreasing agent and/or complex formers, trichloroethylene, acetone, methanol or other so-called aluminum pickles, which are commercially available. Following roughening or, in the case of several roughening steps, between the individual steps, it is possible to perform an additional etching treatment, during which in particular a maximum amount of 2 $g/m^2$ of material is removed (between the individual steps, up to 5 $g/m^2$). Solutions which have an etching effect in general are aqueous alkali metal hydroxide solutions or aqueous solutions of salts having alkaline reactions or aqueous solutions of acids on a basis of $HNO_3$, $H_2SO_4$ or $H_3PO_4$, respectively. Apart from an etching treatment step performed between the roughening step and a subsequent anodizing step, non-electrochemical treatments are also known, which substantially have a purely rinsing and/or cleaning effect and are, for example, employed to remove deposits ("smut") which have formed during roughening or simply to remove electrolyte remainders. Dilute aqueous alkali metal hydroxide solutions or water can, for example, be used for these treatments.

The electrochemical roughening process according to the invention is preferably followed by an anodic oxidation of the aluminum in a further process step, in order to improve, for example, the abrasion and adhesion properties of the surface of the support material. Conventional electrolytes, such as $H_2SO_4$, $H_3PO_4$, $H_2C_2O_4$, amidosulfonic acid, sulfosuccinic acid, sulfosalicylic acid or mixtures thereof, may be used for the anodic oxidation. Particular preference is given to $H_2SO_4$ and $H_3PO_4$, which may be used alone or in a mixture and/or in a multi-stage anodizing process.

The step of performing an anodic oxidation of the aluminum support material is optionally followed by one or more post-treating steps. Post-treating is particularly understood to be a hydrophilizing chemical or electrochemical treatment of the aluminum oxide layer, for example, an immersion treatment of the material in an aqueous solution of polyvinyl phosphonic acid according to German Patent No. 16 21 478 (equivalent to British Published Application No. 1,230,447), an immersion treatment in an aqueous solution of an alkali metal silicate according to U.S. Pat. No. 3,181,461, or an electrochemical treatment (anodic oxidation) in an aqueous solution of an alkali metal silicate according to U.S. Pat. No. 3,902,976. These post-treatment steps serve, in particular, to improve even further the hydrophilic properties of the aluminum oxide layer, which are already sufficient for many fields of application, with the other well-known properties of the layer being at least maintained.

The materials prepared in accordance with this invention are used as supports for offset printing plates i.e., one or the two surfaces of the support material are coated with a radiation-sensitive composition, either by the manufacturers of presensitized printing plates or directly by the users. Suitable radiation- (photo-) sensitive layers basically include any layers which after irradiation (exposure), optionally followed by development and/or fixing, yield a surface in imagewise configuration which can be used for printing.

Apart from the silver halide-containing layers used for many applications, various other layers are known which are, for example, described in "Light-Sensitive Systems" by Jaromir Kosar, published by John Wiley & Sons, New York, 1965: colloid layers containing chromates and dichromates (Kosar, Chapter 2); layers containing unsaturated compounds which, upon exposure, are isomerized, rearranged, cyclized, or crosslinked (Kosar, Chapter 4); layers containing compounds which can be photopolymerized, in which, on being exposed, monomers or prepolymers undergo polymerization, optionally with the aid of an initiator (Kosar, Chapter 5); and layers containing o-diazoquinones, such as naphthoquinone-diazides, p-diazoquinones, or condensation products of diazonium salts (Kosar, Chapter 7).

The layers which are suitable also include the electrophotographic layers, i.e., layers which contain an inorganic or organic photoconductor. In addition to the photosensitive substances, these layers can, of course, also contain other constituents, such as for example, resins, dyes or plasticizers. In particular, the following photosensitive compositions or compounds can be employed in the coating of the support materials prepared in accordance with this invention:

positive-working reproduction layers which contain o-quinone diazides, preferably o-naphthoquinone diazides, such as high or low molecular-weight naphthoquinone-1,2-diazide-2-sulfonic acid esters or amides as the light-sensitive compounds, which are described, for example, in German Pat. Nos. 854,890; 865,109; 879,203; 894,959; 938,233; 1,109,521; 1,144,705; 1,118,606; 1,120,273; 1,124,817 and 2,331,377 and in European Patent Application Nos. 0,021,428 and 0,055,814;

negative-working reproduction layers which contain condensation products from aromatic diazonium salts and compounds with active carbonyl groups, preferably condensation products formed from diphenylaminediazonium salts and formaldehyde, which are described, for example, in German Pat. Nos. 596,731; 1,138,399; 1,138,400; 1,138,401; 1,142,871 and 1,154,123; U.S. Pat. Nos. 2,679,498 and 3,050,502 and British Published Application No. 712,606;

negative-working reproduction layers which contain co-condensation products of aromatic diazonium compounds, such as are, for example, described in German Pat. No. 20 65 732, which comprise products possessing at least one unit each of (a) an aromatic diazonium salt compound which is able to participate in a condensation reaction and (b) a compound which is able to participate in a condensation reaction, such as a phenol ether or an aromatic thioether, which is connected by a bivalent linking member derived from a carbonyl compound capable of participating in a condensation reaction, such as a methylene group;

positive-working layers according to German Offenlegungsschrift No. 26 10 842, German Patent No. 27 18 254 or German Offenlegungsschrift No. 29 28 636, which contain a compound which, on being irradiated, splits off an acid, a monomeric or polymeric compound which possesses at least one C-O-C group which can be split off by acid (e.g., an orthocarboxylic acid ester group or a carboxylic acid amide acetal group), and, if appropriate, a binder;

negative-working layers, composed of photopolymerizable monomers, photo-initiators, binders and, if appropriate, further additives. In these layers, for example, acrylic and methacrylic acid esters, or reaction products of diisocyanates with partial esters of polyhydric alcohols are employed as monomers, as described, for example, in U.S. Pat. Nos. 2,760,863 and 3,060,023, and in German Offenlegungsschriften No. 20 64 079 and 23 61 041;

negative-working layers according to German Offenlegungsschrift No. 30 36 077, which contain, as the photo-sensitive compound, a diazonium salt polycondensation product or an organic azido compound, and, as the binder, a high-molecular weight polymer with alkenylsulfonylurethane or cycloalkenylsulfonylurethane side groups.

It is also possible to apply photo-semiconducting layers to the support materials prepared in accordance with this invention, such as described, for example, in German Patent Nos. 11 17 391; 15 22 497, 15 72 312, 23 22 046 and 23 22 047, as a result of which highly photosensitive electrophotographic printing plates are obtained.

From the coated offset printing plates prepared from the support materials produced in accordance with the present invention, the desired printing forms are obtained in known manner by imagewise exposure or irradiation, followed by washing out the non-image areas by means of a developer, for example, an aqueous-alkaline developer solution.

The process according to this invention combines, inter alia, the following advantages:

The process products have a uniform surface topography, a property, by which both the stability of print runs which can be achieved using printing forms produced from these support materials, and the water/ink balance during printing are positively influenced.

Compared with the use of electrolytes containing purely hydrochloric acid, "pitting" (pronounced depressions, as against the roughening of the surrounding surface) occurs less frequently and can even be suppressed completely.

Compared with the use of a $H_3PO_4$ (see also comparative tests below) surface textures are obtained, which exhibit a more uniform and shallow roughening and which are substantially or even completely free from individual pits (pores).

These surface properties can be materalized without much equipment expenditure, and the properties can be achieved within a wide range of roughening intensities.

Employing this process, surfaces roughened in a particularly shallow and uniform manner can be achieved, which is not possible to the same degree using the known electrolytes.

The mixed electrolyte used in the process of this invention is electrochemically stable, i.e., it practically does not decompose when high current loads (voltages) are applied.

In the above description and in the Examples which follow, percentages denote percent by weight, unless otherwise stated. Parts by weight (p.b.w.) are related to parts by volume (p.b.v.) as grams are related to $cm^3$.

EXAMPLES 1 TO 25 AND COMPARATIVE EXAMPLES C1 TO C16

An aluminum sheet was first treated with an aqueous solution containing 20 g/l of NaOH, at room temperature, for a time of 60 seconds and was then freed from any remaining alkaline residues by briefly dipping it into a solution of a composition corresponding to that of the roughening electrolyte. Roughening was performed in the electrolyte systems and under the conditions described in the Tables below. Roughening was followed by an anodic oxidation in an aqueous electrolyte with a content of $H_2SO_4$ and $Al^{3+}$ ions, until a layer weight of 3 $g/m^2$ was reached.

Classifying into quality grades (surface topography) was made by visual assessment under a microscope, a homogeneously roughened surface which was free from pitting being assigned quality grade "1" (best grade). A surface with severe pitting of a size exceeding 100 μm or with an extremely non-uniformly roughened or almost "mill-finished" surface was assigned quality grade "10" (worst grade). Surfaces of qualities between these two extreme values were assigned quality grades "2" to "9". All examples and comparative examples were performed using symmetric alternating current of a frequency of 50 Hz, one electrode being constituted by the aluminum sheet and the other electrode being constituted by a graphite plate.

TABLE

| Example No. | Concentration and Composition of the aqueous electrolyte: Quantity of HCl (%) | Admixture | Quantity of admixture (%) | Current density ($A/dm^2$) | Roughening time (sec) | Peak-to-valley height $R_z$ (μm) | Quality grade |
|---|---|---|---|---|---|---|---|
| C1 | 1.2 | — | — | 40 | 15 | 4.29 | 4 |
| C2 | 1.2 | — | — | 60 | 10 | 4.03 | 4 |
| C3 | 1.2 | — | — | 80 | 8 | 4.97 | 5 |
| C4 | 1.2 | — | — | 100 | 6 | 5.45 | 4 |
| C5 | 1.2 | — | — | 40 | 20 | 5.14 | 4 |
| C6 | 1.2 | — | — | 80 | 10 | 5.91 | 4 |

TABLE-continued

| Example No. | Concentration and Composition of the aqueous electrolyte: Quantity of HCl (%) | Admixture | Quantity of admixture (%) | Current density ($A/dm^2$) | Roughening time (sec) | Peak-to-valley height $R_z$ (μm) | Quality grade |
|---|---|---|---|---|---|---|---|
| C7 | 1.2 | — | — | 100 | 8 | 6.76 | 5 |
| C8 | 1.2 | — | — | 120 | 6 | 8.49 | 6 |
| C9 | 1.2 | — | — | 40 | 25 | 6.21 | 4 |
| C10 | 1.2 | — | — | 80 | 12 | 7.88 | 6 |
| C11 | 1.2 | — | — | 120 | 8 | 8.03 | 7 |
| C12 | 1.2 | — | — | 40 | 38 | 8.13 | 6 |
| C13 | 1.2 | $H_3PO_4$ | 0.5 | 60 | 10 | 2.76 | 5 |
| C14 | 1.2 | $H_3PO_4$ | 0.5 | 80 | 12 | 5.02 | 4 |
| C15 | 1.2 | $H_3PO_4$ | 1.0 | 100 | 10 | 5.00 | 6 |
| C16 | 1.2 | $H_3PO_4$ | 1.0 | 60 | 10 | 2.63 | 7 |
| 1 | 1.2 | $Na_5P_3O_{10}$ | 0.1 | 100 | 6 | 3.15 | 2 |
| 2 | 1.2 | $Na_5P_3O_{10}$ | 0.2 | 80 | 5 | 3.13 | 1 |
| 3 | 1.2 | $Na_5P_3O_{10}$ | 0.2 | 100 | 4 | 3.07 | 2 |
| 4 | 1.2 | $Na_5P_3O_{10}$ | 0.2 | 60 | 10 | 3.16 | 2 |
| 5 | 1.2 | $Na_5P_3O_{10}$ | 0.2 | 40 | 25 | 5.72 | 1 |
| 6 | 1.2 | $Na_5P_3O_{10}$ | 0.2 | 60 | 17 | 5.62 | 2 |
| 7 | 1.2 | $Na_6P_6O_{18}$ | 0.2 | 100 | 4 | 3.82 | 2 |
| 8 | 1.2 | polyphosphoric acid | 0.1 | 80 | 5 | 3.36 | 1 |
| 9 | 1.2 | polyphosphoric acid | 0.1 | 80 | 8 | 4.21 | 2 |
| 10 | 1.2 | polyphosphoric acid | 0.2 | 80 | 5 | 3.08 | 2 |
| 11 | 1.2 | polyphosphoric acid | 0.2 | 60 | 10 | 3.98 | 1 |
| 12 | 1.2 | polyphosphoric acid | 0.2 | 100 | 6 | 4.15 | 3 |
| 13 | 1.2 | polyphosphoric acid | 0.5 | 80 | 10 | 4.22 | 2 |
| 14 | 1.2 | polyphosphoric acid | 0.5 | 80 | 12 | 4.98 | 2 |
| 15 | 1.2 | polyphosphoric acid | 0.5 | 100 | 10 | 5.14 | 3 |
| 16 | 1.2 | $H_4P_2O_7$ | 0.1 | 80 | 10 | 5.46 | 3 |
| 17 | 1.2 | $H_4P_2O_7$ | 0.1 | 100 | 10 | 5.73 | 2 |
| 18 | 1.2 | $H_4P_2O_7$ | 0.2 | 100 | 8 | 5.05 | 3 |
| 19 | 1.2 | $H_4P_2O_7$ | 0.2 | 80 | 12 | 6.11 | 3 |
| 20 | 1.2 | $H_4P_2O_7$ | 0.2 | 80 | 15 | 6.72 | 3 |
| 21 | 1.2 | $H_2NSO_3H$ | 0.2 | 80 | 8 | 3.84 | 1 |
| 22 | 1.2 | $H_2NSO_3H$ | 0.2 | 60 | 17 | 5.09 | 1 |
| 23 | 1.2 | $H_2NSO_3H$ | 1.0 | 60 | 10 | 3.72 | 2 |
| 24 | 1.2 | $H_2NSO_3H$ | 1.0 | 80 | 8 | 3.86 | 1 |
| 25 | 1.2 | $H_2NSO_3H$ | 1.0 | 100 | 10 | 5.34 | 2 |

EXAMPLE 26

An aluminum sheet prepared in accordance with Example 2 was immersed into an aqueous solution containing 5 g/l of polyvinylphosphonic acid, at a temperature of 40° C. and for a duration of 30 seconds; then it was rinsed with fully deionized water and dried. For obtaining a lithographic printing plate, the sheet was coated with the following negative-working photosensitive solution:

0.70 p.b.w. of the polycondensation product of 1 mole of 3-methoxy-diphenylamine-4-diazonium sulfate and 1 mole of 4,4'-bismethoxymethyl-diphenyl ether, precipitated as the mesitylene sulfonate, 3.40 p.b.w. of an 85% strength aqueous $H_3PO_4$, 3.00 p.b.w. of a modified epoxide resin, obtained by reacting 50 parts by weight of an epoxide resin having a molecular weight of less than 1,000 and 12.8 parts by weight of benzoic acid in ethylene glycol monomethyl ether, in the presence of benzyltrimethylammonium hydroxide, 0.44 p.b.w. of finely-ground Heliogen Blue G (C.I. 74,100), 62.00 p.b.v. of ethylene glycol monomethyl ether, 30.60 p.b.v. of tetrahydrofuran, and 8.00 p.b.v. of butyl acetate.

The printing plate was imagewise exposed and rapidly developed, without scum, with an aqueous solution containing $Na_2SO_4$, $MgSO_4$, $H_3PO_4$, a non-ionic surfactant, benzyl alcohol and n-propanol. When the printing form was used for printing, a very good ink-water balance and an excellent layer adhesion were stated. The print run obtained was 200,000 copies.

EXAMPLE 27

An aluminum foil, which had been prepared in accordance with Example 15 and post-treated in accordance with Example 26, was coated with the following positive-working photosensitive solution:

6.60 p.b.w. of a cresol/formaldehyde novolak (softening range 105° to 120° C., according to DIN 53,181), 1.10 p.b.w. of the 4-(2-phenyl-prop-2-yl)phenyl ester of naphthoquinone-1,2-diazide-2-sulfonic acid-4, 0.60 p.b.w. of 2,2,'-bis-(naphthoquinone-1,2-diazide-2-sulfonyloxy-5)-dinaphthyl-1,1'-methane, 0.24 p.b.w. of naphthoquinone-1,2-diazide-2-sulfochloride-4, 0.08 p.b.w of crystal violet, and 91.36 p.b.w. of a mixture of 4 p.b.v. of ethylene glycol monomethyl ether, 5 p.b.v. of tetrahydrofuran and 1 p.b.v. of butyl acetate.

By imagewise exposure and development in an aqueous solution containing $Na_2SiO_3$, $Na_3PO_4$ and $NaH_2PO_4$, a printing form was produced from this plate, which gave 160,000 prints.

EXAMPLE 28

A support material prepared in accordance with Example 23 was coated with a solution of the following composition in order to obtain an electrophotographic offset printing plate:

10.00 p.b.w. of 2-vinyl-5-(4'-diethylaminophenyl)-4-(2'-chlorophenyl)-oxazole, 10.00 p.b.w. of a copolymer of styrene and maleic anhydride, having a softening point of 210° C., 0.02 p.b.w. of (R)Rhodamine FB, and 300.00 p.b.w. of ethylene glycol monomethyl ether.

By means of a corona, the layer was negatively charged to about 400 V in the dark. The charged plate was imagewise exposed in a reprographic camera and then developed with an electrophotographic suspension-type developer obtained by dispersing 3.0 p.b.w. of magnesium sulfate in a solution of 7.5 p.b.w. of pentaerythritol resin ester in 1,200 p.b.v. of an isoparaffin mixture having a boiling range from 185° to 210° C. After removal of excess developer liquid, the developer was fixed and the plate was immersed, during 60 seconds, in a solution comprised of 35 p.b.w. of sodium metasilicate.$9H_2O$, 140 p.b.w. of glycerol, 550 p.b.w. of ethylene glycol and 140 p.b.w. of ethanol. Then, the plate was rinsed with a vigorous jet of water, whereby those areas of the photoconductor layer, which were not covered by toner, were removed. After rinsing, the printing form was ready for printing.

What is claimed is:

1. A process for the electrochemical roughening of a material selected from aluminum and aluminum alloys, comprising the steps of:

placing the material in an aqueous mixed electrolyte solution containing HCl and at least one additional electrolyte selected from condensed phosphoric acids, amidosulfonic acid, and the water-soluble alkali metal salts and ammonium salts of any of the above acids; and subjecting said material to the action of alternating current to effect roughening of the material surface, said roughening rendering said material suitable for use in a printing plate support;

wherein the mixed electrolyte contains from about 0.5 to about 10% by weight of HCl and from about 0.05 to about 5.0% by weight of the additional electrolyte;

wherein said aqueous mixed electrolyte solution is at a temperature of from about 20° C. to about 60°, the density of said alternating current is from about 3 to about 200 A/dm$^2$.

2. A process as claimed in claim 1, wherein the mixed electrolyte contains from about 0.8 to about 5.0% by weight of HCl and from about 0.1 to about 2.0% by weight of the additional electrolyte.

3. A process as claimed in claim 1, wherein said condensed phosphoric acid is selected from diphosphoric acid and a polyphosphoric acid.

4. A process as claimed in claim 1, wherein said process is continuous, and wherein the rate of flow of said electrolyte over the surface of said material is from about 5 to about 100 cm/sec.

5. A process as claimed in claim 4, wherein the dwell time of said material in said solution is from about 1 to about 300 seconds.

6. A process as claimed in claim 1, wherein said process further includes a pretreatment step with an aqueous NaOH solution.

7. A process as claimed in claim 6, wherein said NaOH solution further contains one or more components selected from degreasing agents, complex formers, trichloroethylene, acetone and methanol.

8. A process as claimed in claim 1, wherein the roughening of the material surface is performed in two or more stages, and wherein an additional etching treatment is performed after each said roughening stage.

9. A process as claimed in claim 1, wherein said additional electrolyte is selected from the group consisting of amidosulfonic acid and the water-soluble alkali metal salts and ammonium salts thereof.

10. A composition for chemical roughening of aluminum or aluminum alloys, comprising:

an aqueous mixed electrolyte solution containing HCl and one or more additional inorganic electrolytes selected from condensed phosphoric acids, amidosulfonic acid, and the water-soluble alkali metal salts and ammonium salts of any of the above acids;

wherein said mixed electrolyte solution contains from about 0.05 to about 10% by weight of HCl and from about 0.05 to about 5.0% by weight of said additional electrolyte.

11. A composition as claimed in claim 10, wherein said mixed electrolytic solution contains from about 0.8 to about 5.0% by weight of HCl and from about 0.1 to about 2.0% by weight of the additional electrolyte.

12. A composition as claimed in claim 10, wherein said condensed phosphoric acid is selected from diphosphoric acid and a polyphosphoric acid.

13. A composition as claimed in claim 10, wherein said composition is used in roughening a material for use in a printing plate support.

14. A composition as claimed in claim 10, wherein said composition consists essentially of an aqueous mixed electrolyte solution of HCl and said one or more additional inorganic electrolytes selected from the group consisting of condensed phosphoric acids, amidosulfonic acid, and the water-soluble alkali metal salts and ammonium salts of any of the above acids.

15. A printing plate support material, comprisng:

a plate of aluminum or aluminum alloy having a roughened surface produced by placing the material in an aqueous mixed electrolyte solution containing HCl and at least one additional electrolyte selected from condensed phosphoric acids, amidosulfonic acid, and the water-soluble alkali metal salts and ammonium salts of the above acids, and subjecting the material to the action of alternating current to effect roughening of the material surface; and a radiation sensitive layer applied over said roughened surface.

16. A printing plate support material as claimed in claim 15, wherein the average peak-to-valley height of the roughened surface is in the range of from about 1 to about 15 μm.

* * * * *